US006088979A

United States Patent [19]

Neal

[11] Patent Number: 6,088,979

[45] Date of Patent: Jul. 18, 2000

[54] FRAME FOR SUPPORTING AN AUXILIARY GLAZING AND METHOD FOR INSTALLING THE IMPROVED FRAME

[76] Inventor: Murray Neal, 9196 Woodlawn Dr., Fresno, Calif. 93720

[21] Appl. No.: 08/958,162

[22] Filed: Oct. 27, 1997

[51] Int. Cl.[7] ..... E06B 1/04

[52] U.S. Cl. ..... 52/212; 52/98; 52/204.54; 52/204.62; 52/717.01; 52/718.05; 52/656.5; 52/786.1

[58] Field of Search ..... 52/98, 211, 212, 52/204.54, 204.61, 204.62, 717.01, 718.05, 718.02, 204.71, 278, 276, 279, 656.5, 786.1; 49/504

[56] References Cited

U.S. PATENT DOCUMENTS

| | | | |
|---|---|---|---|
| 1,525,260 | 2/1925 | Anderson | 52/204.62 |
| 2,174,441 | 9/1939 | Gustafsson | 52/204.62 |
| 2,727,284 | 12/1955 | Adams et al. | 52/98 |
| 3,302,350 | 2/1967 | Brown et al. | 52/718.05 |
| 3,451,168 | 6/1969 | Pengelly . | |
| 3,868,804 | 3/1975 | Tantlinger | 52/98 |
| 4,121,394 | 10/1978 | Brooks . | |
| 4,267,666 | 5/1981 | Davidson . | |
| 4,599,831 | 7/1986 | Magaha, Jr. | 52/98 |
| 4,625,479 | 12/1986 | Giguere . | |
| 4,685,261 | 8/1987 | Seaquist . | |
| 4,825,609 | 5/1989 | Rundo . | |
| 5,426,897 | 6/1995 | Gazaway | 52/204.62 |
| 5,660,010 | 8/1997 | Sayers | 52/211 |
| 5,713,159 | 2/1998 | Schmidt | 52/98 |
| 5,713,167 | 2/1998 | Durham et al. | 52/204.62 |

*Primary Examiner*—Beth A. Stephan
*Assistant Examiner*—Dennis L. Dorsey
*Attorney, Agent, or Firm*—Blakely, Sokoloff, Taylor & Zafman

[57] ABSTRACT

An improved frame and a method to install the frame is disclosed. The sub-base includes a first portion for coupling to a secondary glazing and a first portion for coupling to existing building material. A base includes a first portion having a first surface for coupling to the secondary glazing and a second portion for coupling to the sub-base. A snap cover is provided for removably coupling to the base and for hiding any anchoring employed to secure the base and sub-base to the existing building material. The snap cover also defines a curved surface for contacting with the second glazing so as to minimize marring of the second glazing. The sub-base includes a break-off groove that allows the base and sub-base to flexibly receive glazings of different thicknesses. The base employs a fillet along the length of the base to provide additional support for the secondary glazing.

19 Claims, 4 Drawing Sheets

FRAME FOR SUPPORTING AN AUXILIARY GLAZING AND METHOD FOR INSTALLING THE IMPROVED FRAME

BACKGROUND OF THE INVENTION

1. Field of the Invention

The present invention relates generally to frames that support glazings, and more specifically, relates to a method and apparatus for an improved frame for supporting an auxiliary glazing.

2. Description of the Related Art

In an increasing violent society, businesses and homes are subject to an increased number of threats against both life and property. These threats to life and property can include ballistic threats, threats of explosive blasts, forced entry threats, and others.

Businesses and homes in areas of high crime are increasingly forced to employ security measures to protect against these threats. These security measures include the installation of glazings with increased strength. For example, bullet resistant glazings or glazings that can resist certain explosive blasts are finding their way into both residential and industrial buildings.

Additionally, buildings in areas that are subject to natural disaster, such as hurricanes, tornadoes and severe storms, require weatherproofing and additional protection from the elements.

Unfortunately, conventional security improvement schemes require that the existing window and frame be removed and replaced with a new glazing and a new frame. Because the old windows and frames need to be removed first before the new windows and frames can be installed, the costs of such a job are greatly increased. Moreover, the area downtime, that is, the time required for workmen to come in, tear down the existing structure, and install the new structure, is also substantial. Furthermore, there is a risk of contamination to the work-area resulting from the demolition and reconstruction of the frame and surrounding building structure.

Another disadvantage of conventional schemes is that the noise, commotion and disruption inherent in tearing out the old frame and existing building materials, in addition to the significant down-time, precludes a discreet security enhancement. Because of the conspicuous nature of conventional schemes, they may unnecessarily cause fear in the workplace or unwittingly reveal to third parties the additional security measures.

Also, the conventional technique for increasing the security of a building is time-consuming and costly, requiring substantial lead time for pre-fabrication of the new frame prior to installation.

Furthermore, conventional retrofit methods for increasing the security of a building cannot be aesthetically finished and leaves unsightly anchoring, such as screws or other evidence of sizing the frame (e.g., cut marks, edges, scratches).

Furthermore, once the new window glazing is in place, conventional frames do not allow for upgrades to glazings with a greater thickness. In order to upgrade with conventional frames, the entire frame must be removed and a suitable frame having dimensions to accommodate the glazing having a greater thickness must be installed.

Another disadvantage is that conventional frames and methods to install them are costly, time-consuming, and require two or more workers to aid in positioning the glass or glazing in the frames.

Accordingly, there remains a need in the industry for an improved frame and a method of installing the improved frame that overcomes the advantages set forth previously.

SUMMARY OF THE INVENTION

It is one object of the present invention to provide an improved frame for supporting and holding a secondary glazing without the need to remove or replace an existing glazing and existing frame.

It is another object of the present invention to provide an improved frame that flexibly adjusts to glazings of different thicknesses. The present invention flexibly accommodates glazings of different thicknesses without the need to replace the frame.

It is another object of the present invention to provide a base having a fillet that substantially increases the lateral support loading provided by the improved frame to a glazing.

It is another object of the present invention to provide a snap cover for an aesthetically pleasing frame.

It is another object of the present invention to provide a base and sub-base each defining a plurality of serrations and a sub-base defining a locking ridge to further increase the resistance to translational movement between the base and the sub-base.

It is another object of the present invention to provide a sub-base that provides an air gap between a first glazing and an auxiliary glazing so as to prevent expansion effects between the two glazings due to temperature change.

It is also an object of the present invention to provide an improved frame that is cost-effective, and a method of installing that is suitable for one-person to handle that reduces the amount of time and effort involved in installation.

It is also an object of the present invention to provide an improved frame to support auxiliary glazing in a discreet and quick manner so as to maintain the privacy and secrecy of obtaining the additional protection. This secrecy and privacy minimizes knowledge of the additional security measures by third parties and also minimizes any fear component of those who dwell in the particular buildings (e.g., employees).

In an alternative embodiment of the present invention, it is an object of the present invention to provide an improved frame to support safety and/or security films and laminates to an existing glazing. The laminate strengthens the existing glazing to make the glazing shatterproof or weatherproof. The present invention includes a snap cover that defines a curved edge for contact with the laminate. Because of the curved shape, the laminate is not marred.

BRIEF DESCRIPTION OF THE DRAWINGS

The objects, features and advantages of the method and apparatus for the present invention will be apparent from the following description in which:

FIG. 7A illustrates a perspective view of one embodiment of the improved frame of the present invention for accommodating a glazing having a first thickness. FIG. 7B illustrates a perspective view of one embodiment of the improved frame of the present invention for accommodating a glazing having a second thickness.

DETAILED DESCRIPTION OF THE INVENTION

Referring to the figures, exemplary embodiments of the invention will now be described. The exemplary embodiments are provided to illustrate aspects of the invention and should not be construed as limiting the scope of the invention. The exemplary embodiments are primarily described with reference to the figures.

Figure 1:
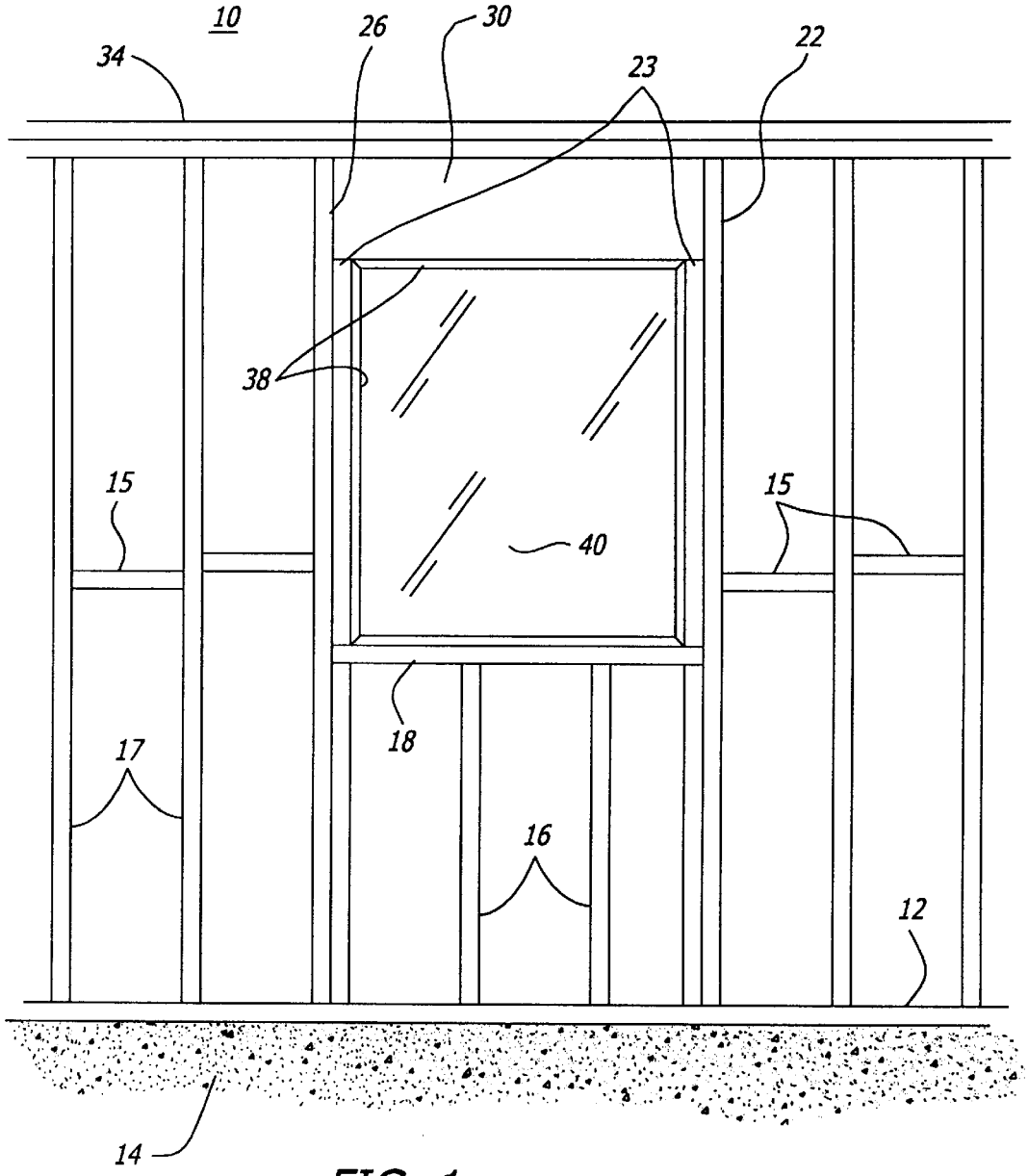
FIG. 1 A (PRIOR ART)
FIG. 1A illustrates an elevation view of a structure in which the present invention can be implemented.
FIG. 1B illustrates a plan view of a plate layout of the structure illustrated in FIG. 1A.
Figure 1:
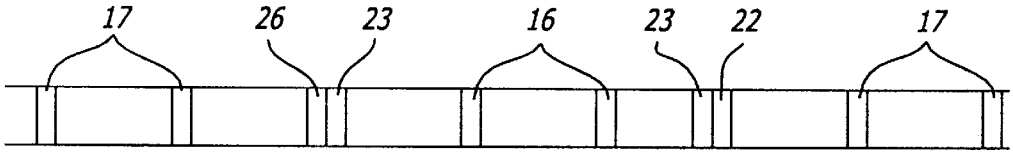
FIG. 1 B (PRIOR ART)

FIG. 1A illustrates an elevation view of a structure 10 in which the present invention can be implemented. The structure 10 can be found in commercial and residential buildings. The structure 10 includes a bottom plate 12 which is coupled to a foundation 14. A plurality of cripple studs 16 extend from the bottom plate 12 to a sill 18. Common studs 17 extend from the bottom plate 12 to a double top plate 34. Common studs that help to define an opening such as a door way or window are commonly referred to as king studs 22 and 26. The sill 18 includes a first end that is coupled to a first king stud 22 and a second end that is coupled to a second king stud 26. Blocking studs 15 are disposed between common studs 17. A header 30 is coupled to the king studs 22, 26 and the double top plate 34 which is coupled to a roof line or to a next floor. Trimmer studs 23 each have one portion that extends between the bottom plate 12 and the sill 18 and a second portion that extends from the sill 18 to the header 30. An existing window frame 38 is coupled to the sill 18, the king studs 22 and 26, the trimmer studs 23 and the header 30. An existing glazing 40 is held by the existing frame 38. The improved frame 200 of the present invention can be coupled to the sill 18, the king studs 22 and 26, and the header 30.

FIG. 1B illustrates a plan view of a plate layout of the structure illustrated in FIG. 1A. The plate layout includes king studs 22 and 26, trimmer studs 23, common studs 17, and cripple studs 16.

Figure 2:
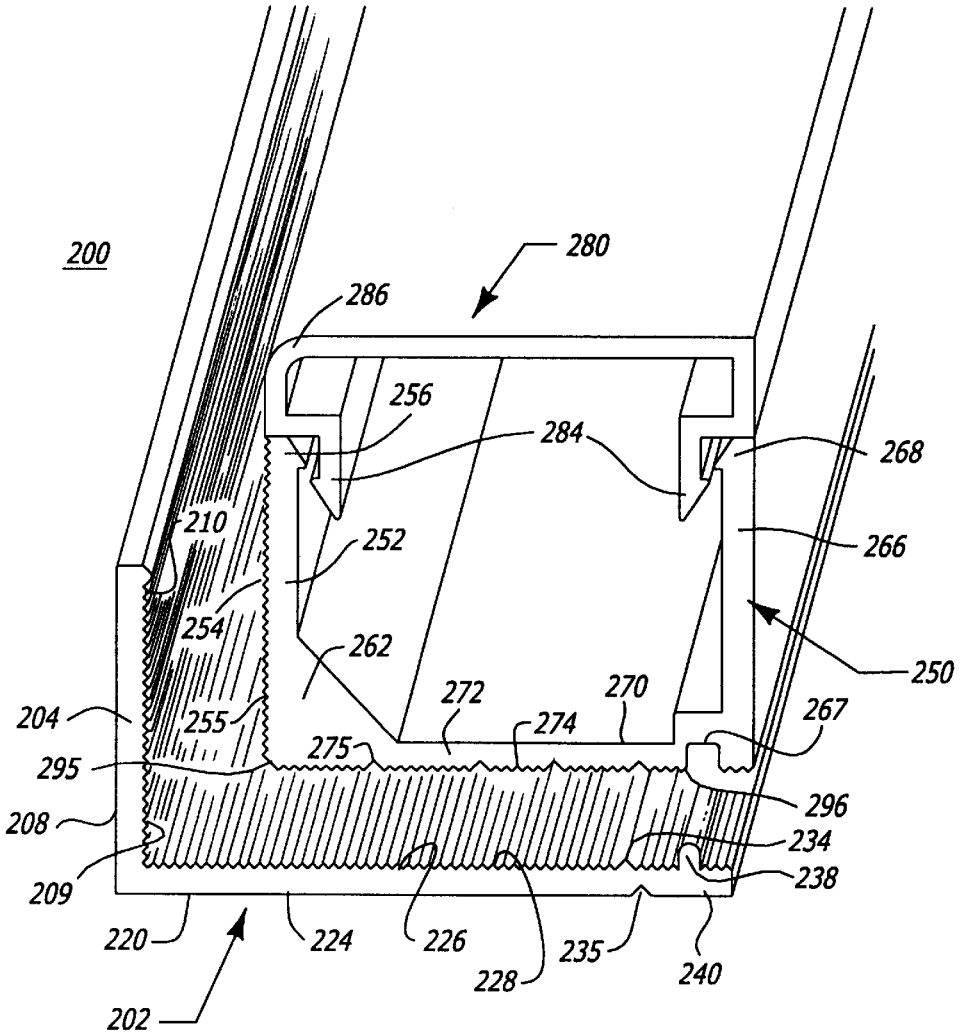
FIG. 2 illustrates a perspective view of one embodiment of the improved frame of the present invention.

FIG. 2 illustrates a perspective view of one embodiment of the improved frame 200 of the present invention. The improved frame 200 of the present invention includes a sub-base 202, a base 250, and a snap cover 280.

I. Sub-Base

The sub-base 202 includes a first portion 204 that has a first surface 208 and a second surface 209. The first surface 208 is for engaging a first glazing (not shown), such as element 40 of FIG. 1. The second surface 209 is for engaging with a second glazing (also not shown). In the preferred embodiment, the second surface 209 defines a plurality of serrations 210 that provide excellent support for the second glazing without scratching or marring the surface of the second glazing.

The sub-base 202 includes a second portion 220 that includes a first surface 224 and a second surface 226. The first surface 224 is for coupling with existing building materials (e.g., an existing frame, a sill, trimmer stud, king stud, header). The second surface 226 is for engaging the base 250. The second surface 226 defines a plurality of serrations 228 that when employed in conjunction with serrations defined by the base 250, hereinafter described, provide additional frictional resistance to translational motion of the base 250 with respect to the sub-base 202. The second surface 226 of the second portion 220 forms a locking ridge 234 and a shim ridge 238, which will be described in greater detail hereinafter. The first surface 224 forms a break-off first groove 235 that enables a third portion 240 to be broken from the second portion 220. The third portion 240 includes the shim ridge 238. After the third portion 240 is broken off from the second portion 220, the third portion 240 can be employed to flexibly adapt the present invention to accommodate secondary glazings of different thickness, as described hereinafter with reference to FIGS. 7A and 7B.

II. Base

The base 250 includes a first portion 252 and a second portion 270. The first portion has a first surface 254 for engaging the second glazing. The first surface 254 defines a plurality of serrations 255 that provide excellent support for the second glazing without scratching the finish of the secondary glazing. The first portion 252 defines a protruding portion 256 that engages an arm of a snap cover 280 described hereinafter. The base 250 also includes a fillet 262, including a chamfer 295, which in the preferred embodiment, is solid throughout the length of the base 250. The fillet 262 substantially increases the strength of the base 250, and specifically the first portion 252. The fillet 262 enables the first portion 252 to withstand approximately five times more force exerted against the first portion 252 by the secondary glazing as compared to a base without the fillet 262.

The second portion 270 has a first surface 272 for defining a plurality of serrations 274. As described previously, the first surface 272 is for engaging the second surface 226 of the sub-base 202. The serrations 274 mate with the serrations defined by the second surface 226 of the sub-base 202. The second portion 270 of the base 250 also forms a shim receiving groove 267 that receives the shim ridge 238 of the sub-base 202. The base 250 also includes a third portion 266 that defines a protruding member 268 for engaging an arm of the snap cover 280 hereinafter described.

III. Snap-Cover

The snap cover 280, which provides an aesthetically pleasing finish, defines protruding arm members 284 that removably couple to corresponding protruding members 256 and 268 of the base 250.

The snap cover 280 features a rounded portion 286 that minimizes the marring of the secondary glazing and/or security film or laminate. Snap cover 280 is snapped into place to couple to the base 250 to hide means for anchoring the sub-base to the existing frame and/or other building materials as noted in FIG. 1.

Figure 3:
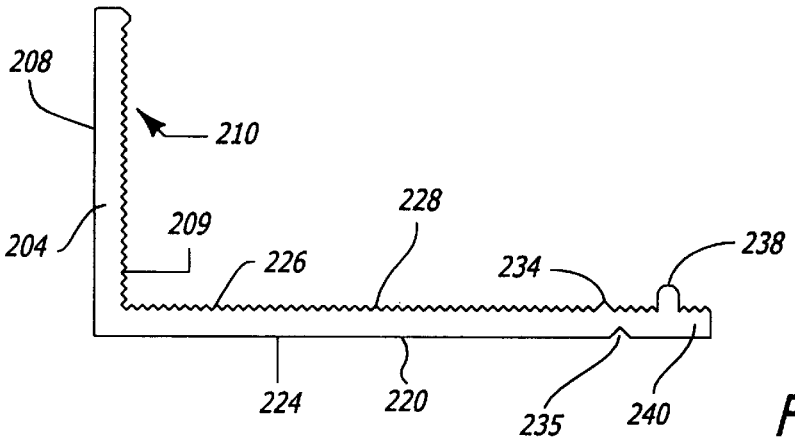
FIG. 3 illustrates a cross-sectional view of the sub-base illustrated in FIG. 2.

FIG. 3 illustrates a cross-sectional view of the sub-base 202 illustrated in FIG. 2. The sub-base 202 includes a first portion 204 and a second portion 220. The first portion 204 includes a first surface 208 for coupling to a first glazing (not shown), and a second surface 209 that forms a plurality of serrations and that is for coupling to the second glazing (not shown).

The second portion includes a first surface 224 for coupling to an existing frame or other existing building material.

The second portion includes a second surface 226 defining a plurality of serrations for coupling to the base 250. The second portion 220 includes a first end that is integrally coupled to the first portion 204 and a second end. The second surface 226 forms a locking ridge 234 adjacent the second end. Moreover, the second surface 226 forms a shim ridge 238 for coupling with the base unit 250 also adjacent the second end. The first surface 224 forms a break-off 235 adjacent the second end to enable a portion of the second portion 220 to be broken off from the second portion 220 and separated therefrom.

Figure 4:
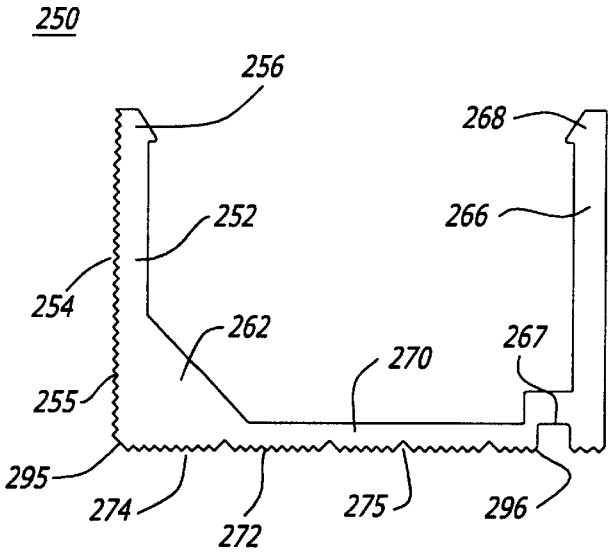
FIG. 4 illustrates a cross-sectional view of the base illustrated in FIG. 2.

FIG. 4 illustrates a cross-sectional view of the base 250 illustrated in FIG. 2. The base 250 includes a first portion 252 having a first surface 254 for coupling to the secondary glazing. The first portion 270 includes a second surface 272 that forms a plurality of locking grooves 275 for receiving the locking ridge 234. The first surface 272 also includes a plurality of serrations 274 275 for interlocking with the serrations 228 on the second surface 226 of the sub-base 202. The first surface 272 has a chamfer 296 and also forms a shim receiving channel 268. The third portion 266 and the first portion 252 each includes a first end forming a protruding member 256 and 268, respectively. The protruding members 256 and 268 are for engaging the corresponding protruding member 284 of the snap cover 280. The base 250 includes a fillet 262, and chamfer 295 which as noted previously, substantially increases the strength of the base to withstand pressure against the first portion 252.

Figure 5:
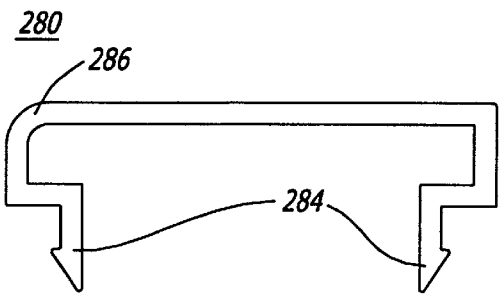
FIG. 5 illustrates a cross-sectional view of the snap cover illustrated in FIG. 2.

FIG. 5 illustrates a cross-sectional view of the snap cover 280 illustrated in FIG. 2. The snap cover 280 defines a rounded surface 286 for engaging the secondary glazing. The rounded surface 286 prevents scoring of the secondary glazing that can weaken the secondary glazing. The snap cover 280 also defines a pair of protruding arm members 284 for engaging the base.

Figure 6:
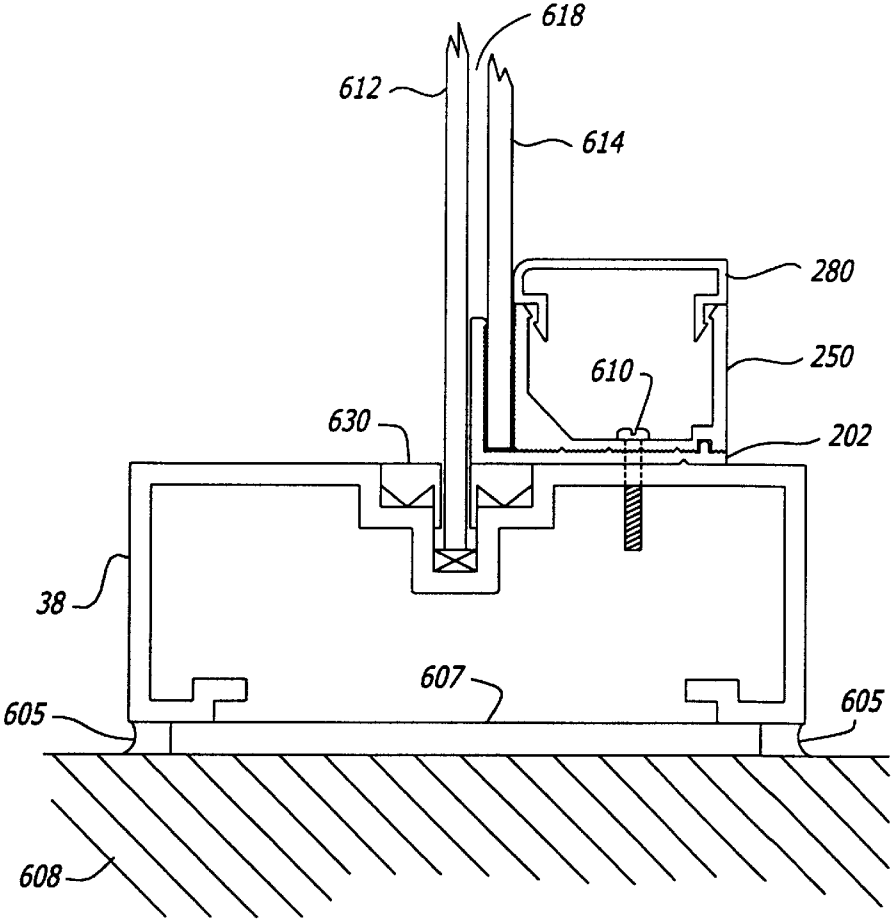
FIG. 6 illustrates a cross-sectional view of one embodiment of the present invention showing how the improved frame interacts with a first glazing, a second glazing, and existing building materials.

FIG. 6 illustrates a cross-sectional view of one embodiment of the present invention showing how the improved frame 200 interacts with a first glazing 612, a second glazing 614, and existing building materials 608. The first glazing 612 can be an existing window. The existing building materials 608 can include sill 18, trimmer studs 23, king studs 22, and header 3.

A frame 38 is mounted on a shim 607, and sealants 605 are disposed between the frame 38 and building frame materials 608 so as to provide a sealed interface. The existing building materials 608 can include the sill 18, king studs 22, or header 30 referred to in FIG. 1.

The present invention, including the sub-base 202, the base 250, and the snap cover 280, are anchored to the existing frame 38 and also anchored to the existing building materials 608. In one embodiment, the anchoring is performed by a first set of screws 610 that extend through the base 250, the sub-base 202, into the frame 38. Further anchoring is performed by a second set of screws (not shown) that extend through the base 250, sub-base 202, the frame 38, and existing building materials 608. The first glazing 612 is positioned in a groove, defined by frame 38, by gaskets 630. The second glazing 614 is separated by the first glazing 612 by the first portion of the sub-base 202. Consequently, an air space 618 is provided between the first glazing 612 and the second glazing 614. The base 250 is coupled to the second glazing 614 via an adhesive or very heavy bond tape.

Figure 7A:
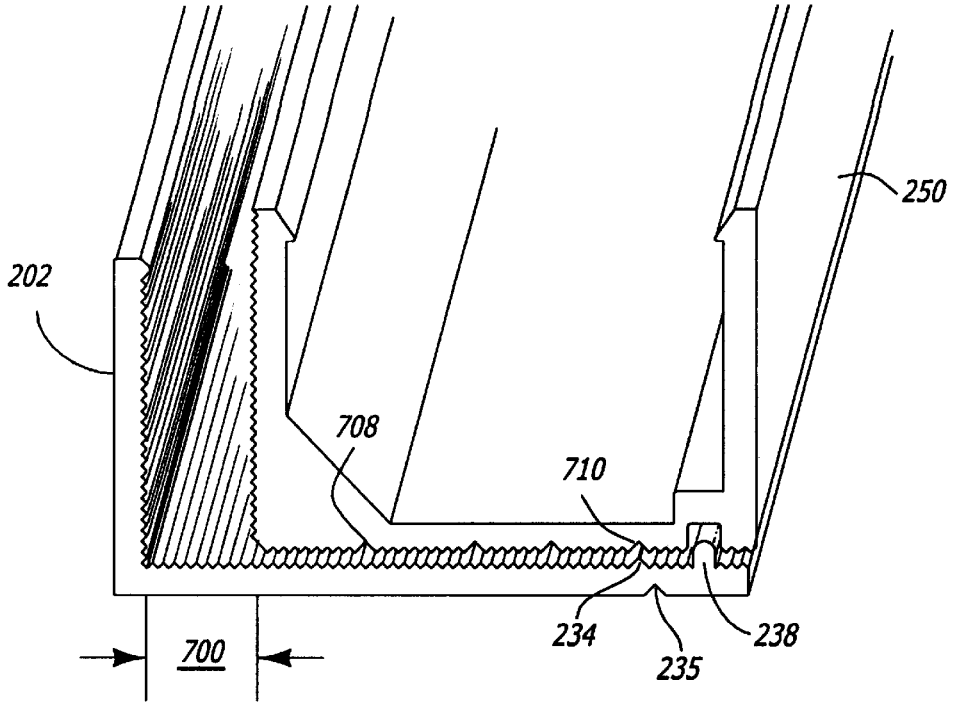
FIGS. 7A and 7B illustrate how the present invention flexibly accommodates for glazings of different thicknesses.
Figure 7B:
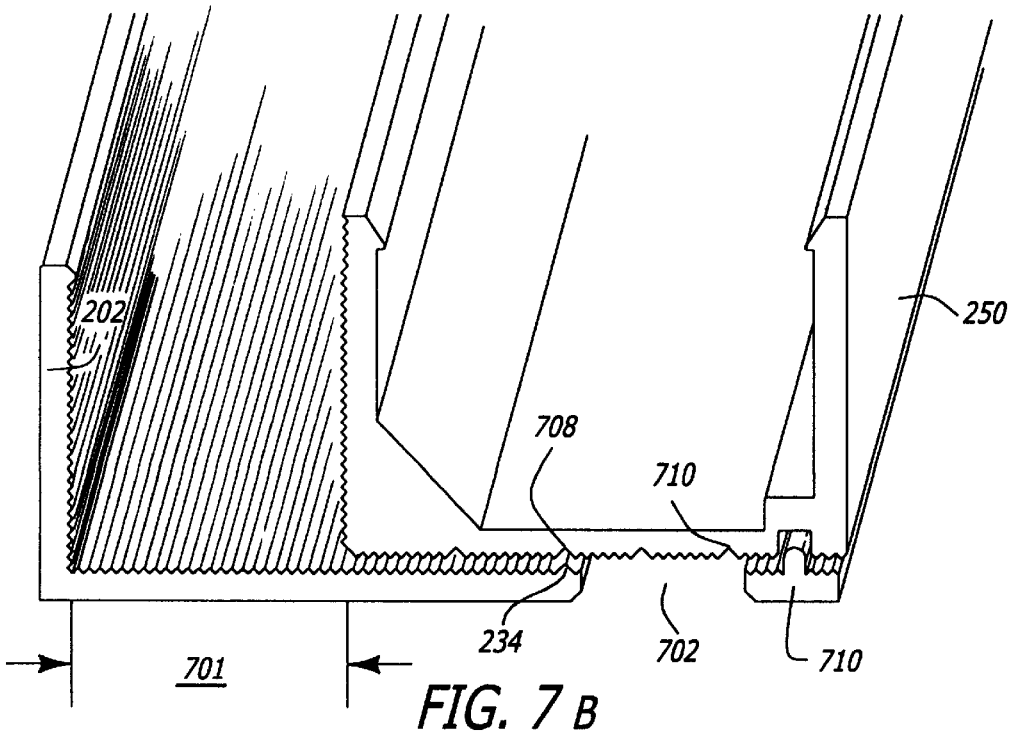

FIGS. 7A and 7B illustrate how the present invention flexibly accommodates for second glazings of different thicknesses by employing the different locking grooves of the base to engage with the locking ridge. FIG. 7A illustrates a perspective view of one embodiment of the improved frame of the present invention for accommodating a glazing having a first thickness. FIG. 7B illustrates a perspective view of one embodiment of the improved frame of the present invention for accommodating a glazing having a second thickness.

For a second glazing having a thickness greater than can be accommodated when the locking ridge engages the first locking groove, the following steps are performed. First a portion of the sub-base 202 is broken off at the break-off groove 235. Second, the shim ridge 238 is coupled to the base 250 at the receiving portion of the base 250 and the base 250 can be moved from the sub-base 202 to increase the space between the first portion 204 of the sub-base 202 and the first portion 252 of the base 250. Consequently, the present invention can be flexibly adapted to hold glazings of different thicknesses. In the preferred embodiment, the improved frame of the present invention can flexibly accommodate glazings having thicknesses of 0.25, 0.50, 0.75, 1, or 1.25 inches.

The first portion 204 of the sub-base 202 ensures an air space 618 between the second glazing 614 and the first glazing 612 which is important so as to allow expansion of the first glazing and the second glazing.

As described previously, the present invention flexibly accommodates for glazings of different thicknesses. The spacing 700 can accommodate glazings having a thickness of up to a predetermined size (e.g., 0.25 inches), which is determined by the spacing 700. To increase the spacing to a new size 701, a portion of the sub-base 202 is detached from the sub-base 202 at the break-off groove 235 to form a separate portion 720. Any anchorings are removed. The base 250, with the portion 720 coupled as shown, is moved so as to increase the spacing 700 to a new spacing 701. Moreover, the locking ridge 234, which previously mated with locking groove 710 is correspondingly moved to engage a new locking groove 708, as shown in FIG. 7B. The sub-base 202 and base 250 are anchored to the existing building material.

METHOD OF INSTALLING THE PRESENT INVENTION TO EXISTING BUILDING MATERIALS

1. Fix the sub-base 202 to the existing building material 608 via adhesive or screws.

2. Place second glazing 614 against the first portion of the sub-base 202.

3. Couple the base 250 to the secondary glazing via adhesive.

4. Anchor the base 250 and sub-base 202 to the existing frame every first predetermined distance. In the preferred embodiment, anchors are provided every twelve (12) inches.

5. Anchor the base 250 and sub-base 202 to the sill 18, trimmer studs 23, king studs 22 and 26, and header 30 every second predetermined distance. In the preferred embodiment, anchors are provided every twenty-four (24) inches, or a minimum of three (3) anchors per lineal length are provided. Lineal length used herein refers to one of the four sides of the improved frame. Should one side be less than twenty-four (24) inches in length, three anchors are still provided for that lineal length.

6. Fit snap cover into base 250 to hide the anchoring means for coupling the base 250 and sub-base 202 to the existing frame material.

It is important to note that, in the preferred embodiment, the improved frame of the present invention is installed along the perimeter (i.e. all edges) of the glazing.

Fastening means or anchoring means used herein can include, but are not limited to, threaded fasteners such as nuts and bolts, screws, hook and pile fasteners, adhesives and epoxies, hooks, rivets, welding, surface tension, steel shaft rivets, wedge or sleeve expansion anchors, coil-loop or epoxy anchors, etc.

In the preferred embodiment, the sub-base, base and snap cover are manufactured by an extrusion process and are manufactured from aluminum. For straight portions, used for rectangular or square windows, the aluminum 6063-T5 is the preferred material. For windows having non-straight portions (e.g., circular windows or arched windows), the preferred material is the aluminum 6063-T1 material. The aluminum 6063-T1 provides additional malleability so that the material can be formed into curved portions.

Accordingly, the present invention has been described with some degree of particularity directed to the exemplary embodiments of the present invention. The exemplary embodiments described herein are provided merely to illustrate the principles of the invention and should not be construed as limiting the scope of the invention. It should be appreciated, though, that the present invention is defined by the following claims construed in light of the prior art so that modifications or changes may be made to the exemplary embodiments of the present invention without departing from the inventive concepts contained herein.

What is claimed is:

1. An improved frame comprising:

a) a sub-base having a first portion and a second portion, said first portion having a first surface for engaging a first glazing and a second surface for engaging a second glazing, and said second portion having a first surface for engaging existing building material and a second surface defining a plurality of serrations; and b) a base having a first portion for engaging the second glazing, and a second portion having a first surface for engaging the second surface of the second portion of the sub-base;

wherein the first portion of the sub-base and the first portion of the base define a channel for cooperatively supporting the second glazing.

2. The improved frame of claim 1 wherein the second surface of the second portion of the sub-base defines a break-off groove, said break-off groove for allowing a portion of the sub-base to be detached from the sub-base, and for allowing the improved frame to flexibly adapt to said second glazings of different thicknesses.

3. The improved frame of claim 1 wherein the second surface of the first portion and the second portion of the sub-base defines a plurality of serrations.

4. The improved frame of claim 1 wherein the second surface of the second portion of the sub-base defines a locking ridge; and wherein said first surface of said second portion of the base defines a locking groove for receiving the locking ridge of the sub-base.

5. The improved frame of claim 1 wherein the second surface of the second portion of the sub-base defines a shim ridge; and wherein the first surface of the second portion of the base further defines a shim groove for receiving the shim ridge of the sub-base.

6. The improved frame of claim 1 wherein the first surface of the first portion and the second portion of the base further defines a plurality of serrations.

7. The improved frame of claim 1 wherein the base further includes a third portion, said first portion and third portion of the base defining a first and second protruding member, respectively; the improved frame further including a snap cover having a first and second protruding arm member for removably coupling to said base and for engaging the first and second protruding members of the base.

8. The improved frame of claim 7 wherein said snap cover defines a curved surface for engaging a second glazing.

9. The improved frame of claim 7 wherein the sub-base, base and snap cover are made from one of an aluminum 6063-T5 material and an aluminum 6063-T1 material.

10. The improved frame of claim 1 wherein the base includes a fillet coupled to the first and second portion for providing support to the first portion.

11. The improved frame of claim 1 further comprising means for coupling the base and sub-base to the existing building material.

12. The improved frame of claim 1 wherein the existing building material is one of an existing frame, a sill, a trimmer stud, a king stud, and a header.

13. A method of installing an improved frame to existing building material comprising the steps of:

a) positioning a sub-base having a first portion on the existing building material;

b) positioning a glazing against a first portion of the sub-base;

c) engaging a base to the glazing; and d) passing an anchor through the base and sub-base to the existing building material at a plurality of first predetermined distance.

14. The method of claim 13 further comprising the step of anchoring the base and sub-base to an existing frame at a plurality of second predetermined distance.

15. The method of claim 13 further comprising the step of coupling a snap cover to the base.

16. The method of claim 13 wherein the first predetermined distance is one of twenty-four (24) inches or a minimum of three (3) anchors per lineal length.

17. The method of claim 13 further comprising the step of anchoring the base and sub-base to one of a sill, king studs, trimmer studs, and a header.

18. An improved frame for holding and supporting a glazing having a safety film comprising:

a) a base having a first portion for engaging the glazing, a second portion for coupling to an existing building material, and a chamfer between the first portion and the second portion and;

b) a snap cover, for removably coupling to said base, said snap cover having a rounded portion engaging the glazing, and further having two arms for engaging at said base, said base having two corresponding protrusions.

19. The improved frame of claim 18 wherein the base and snap cover are made from one of an aluminum 6063-T5 material and an aluminum 6063-T1 material.

* * * * *